US012035750B2

(12) United States Patent
Qiu

(10) Patent No.: US 12,035,750 B2
(45) Date of Patent: Jul. 16, 2024

(54) ATOMIZER AND ELECTRONIC CIGARETTE

(71) Applicant: CHANGZHOU PATENT ELECTRONIC TECHNOLOGY CO., LTD, Changzhou (CN)

(72) Inventor: Weihua Qiu, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 615 days.

(21) Appl. No.: 17/321,527

(22) Filed: May 17, 2021

(65) Prior Publication Data

US 2021/0267277 A1 Sep. 2, 2021

Related U.S. Application Data

(63) Continuation-in-part of application No. PCT/CN2019/114976, filed on Nov. 1, 2019.

(30) Foreign Application Priority Data

Nov. 15, 2018 (CN) ..... 201821889324.5

(51) Int. Cl.
*A24F 40/40* (2020.01)
*A24F 40/46* (2020.01)
*A24F 40/95* (2020.01)

(52) U.S. Cl.
CPC ..... *A24F 40/46* (2020.01); *A24F 40/95* (2020.01)

(58) Field of Classification Search
CPC ..... A24F 40/46; A24F 40/40; A24F 40/95; A24F 40/20; A24F 40/10
(Continued)

(56) References Cited

U.S. PATENT DOCUMENTS 11,871,794 B2 * 1/2024 Qiu ..... A24F 40/485
2012/0199663 A1 * 8/2012 Qiu ..... A24F 40/42 239/8

(Continued)

FOREIGN PATENT DOCUMENTS

CN 203168036 U 9/2013
CN 104287095 A 1/2015

(Continued)

OTHER PUBLICATIONS

International Search Report of PCT Patent Application No. PCT/CN2019/114976 issued on Feb. 12, 2020.

*Primary Examiner* — Harshad C Patel
(74) *Attorney, Agent, or Firm* — Andrew C. Cheng

(57) ABSTRACT

An atomizer includes a housing structure, a connecting structure installed at one end of the housing structure, and a heating structure installed in the housing structure. The connecting structure includes a first conductive member provided below the housing structure, a second conductive member provided in the first conductive member, an insulating member provided between the first conductive member and the second conductive member, and a third conductive member provided in the second conductive member. The heating structure includes a heating member. The heating member includes a main body, and a first electrode contact and a second electrode contact configured for electrically connecting with the main body. The first electrode contact is clamped between the first conductive member and the housing structure. The second electrode contact is clamped between the second conductive member and the third conductive member.

19 Claims, 13 Drawing Sheets

(58) Field of Classification Search
USPC ..... 131/329
See application file for complete search history.

(56) References Cited

U.S. PATENT DOCUMENTS

| | | | | |
|---|---|---|---|---|
| 2015/0059787 | A1* | 3/2015 | Qiu | A24F 40/46 392/395 |
| 2015/0317558 | A1* | 11/2015 | Adachi | G06N 3/04 706/19 |
| 2018/0000156 | A1* | 1/2018 | Qiu | A24F 40/40 |
| 2018/0168236 | A1* | 6/2018 | Qiu | A61M 15/002 |
| 2018/0263282 | A1* | 9/2018 | Qiu | A24F 40/46 |
| 2018/0279683 | A1* | 10/2018 | Qiu | A24F 40/42 |
| 2018/0310627 | A1* | 11/2018 | Qiu | A24F 7/00 |
| 2018/0310628 | A1* | 11/2018 | Qiu | A24F 40/485 |
| 2018/0317559 | A1* | 11/2018 | Qiu | A24F 40/485 |

FOREIGN PATENT DOCUMENTS

| | | | |
|---|---|---|---|
| CN | 104824854 | A | 8/2015 |
| CN | 205757177 | U | 12/2016 |
| CN | 206808667 | U | 12/2017 |
| CN | 207995918 | U | 10/2018 |
| CN | 209346094 | U | 9/2019 |
| WO | 2015021612 | A1 | 2/2015 |

* cited by examiner

ATOMIZER AND ELECTRONIC CIGARETTE

CROSS-REFERENCE TO RELATED APPLICATIONS

This application is a continuation-in-part of International patent application No. PCT/CN2019/114976, filed on Nov. 1, 2019, which claims priority to Chinese patent application No. 201821889324.5, filed on Nov. 15, 2018. All of the aforementioned patent applications are hereby incorporated by reference in their entireties.

TECHNICAL FIELD

The present disclosure relates to the technical field of simulated smoking, and more particularly, relates to an atomizer and an electronic cigarette having the atomizer.

BACKGROUND

Electronic cigarettes, also known as virtual cigarettes, electronic atomizers, and electronic cigars, have the same appearance as cigarettes and a similar taste to cigarettes. They are mainly used to simulate the feeling of smoking for smoking cessation or alternative use of cigarettes. Generally, the first electrode contact and the second electrode contact are both single-sided electrical contacts, and the electrical connection at the electrical connection point is unstable.

SUMMARY

Based on the above, it is necessary to provide an atomizer with stable electrical connection and an electronic cigarette having the atomizer.

The technical solution adopted by the present disclosure to solve its technical problems is as follows.

An atomizer includes a housing structure, a connecting structure installed at one end of the housing structure, and a heating structure installed in the housing structure, wherein:

- the connecting structure includes a first conductive member provided below the housing structure, a second conductive member provided in the first conductive member, an insulating member provided between the first conductive member and the second conductive member, and a third conductive member provided in the second conductive member;
- the heating structure includes a heating member, the heating member includes a main body, and a first electrode contact and a second electrode contact configured for electrically connecting with the main body;
- the first electrode contact is clamped between the first conductive member and the housing structure, and the first electrode contact, the first conductive member and the housing structure are electrically connected to each other;
- the second electrode contact is clamped between the second conductive member and the third conductive member, and the second electrode contact, the second conductive member and the third conductive member are electrically connected to each other.

Further, the first conductive member includes a first conductive body and a first abutting portion formed by protruding outwardly from the first conductive body along the radial direction of the first conductive body, the first electrode contact is clamped between the upper end surface of the first abutting portion and the housing structure.

Further, the outer surface of the first conductive body is provided with a second receiving groove extending downward from the upper end surface of the first conductive body to the upper end surface of the first abutting portion along the axial direction of the first conductive member, the first electrode contact passes through the second receiving groove and is clamped between the upper end surface of the first abutting portion and the housing structure.

Further, the lower end surface of the housing structure is provided with an opening for installing the first conductive member, the lower end surface of the housing structure is provided with a first receiving groove in communication with the opening along the radial direction of the housing structure, the first electrode contact passes through the second receiving groove and is clamped between the upper end surface of the first abutting portion and the first receiving groove.

Further, the second conductive member includes a mounting hole provided in the lower end surface of the second conductive member and configured for installing the third conductive member, an insertion hole provided in the upper end surface of the second conductive member and in communication with the mounting hole, the inner diameter of the mounting hole is greater than the inner diameter of the insertion hole, a limiting step is formed at the junction between the mounting hole and the insertion hole, the second electrode contact passes through the insertion hole and is clamped between the limiting step and the third conductive member.

Further, the upper end surface of the second conductive member is further provided with a groove in communication with the insertion hole, the groove is formed on the upper end surface of the second conductive member by recessing gradually downwardly along the radial direction of the second conductive member from the outer edge toward the center of the second conductive member, the insertion hole is located at the center of the bottom of the groove.

Further, the connecting lines of various points from the outer edge of the groove to the center of the groove along the radial direction of the second conductive member are straight lines, and the angles between the straight lines and the axis of the second conductive member are the same.

Further, the lower end surface of the third conductive member is provided with a pressing hole, by applying a force outwardly to the pressing hole along the radial direction of the third conductive member, the side wall of the third conductive member is deformed outwardly along the radial direction of the third conductive member.

An electronic cigarette includes the atomizer as described above.

An electronic cigarette includes an atomizer and a battery device electrically connected to the atomizer, wherein:

- the battery device includes a battery housing and a battery received in the battery housing;
- the atomizer includes a housing structure, a connecting structure installed at the lower end of the housing structure, and a heating structure installed in the housing structure;
- the lower end of the housing structure protrudes inwardly along the radial direction of the housing structure to form a second limiting portion, an opening is formed and extends through the second limiting portion from the upper surface to the lower surface of the second limiting portion;
- the connecting structure includes a first conductive member at least partially received in the opening, a second conductive member provided in the first conductive member, an insulating member provided between the first conductive member and the second conductive member, and a third conductive member provided in the second conductive member;

the heating structure includes a heating member, the heating member includes a main body, and a first electrode contact and a second electrode contact configured for electrically connecting with the main body;

the first electrode contact is clamped between the first conductive member and the second limiting portion of the housing structure, wherein the first electrode contact, the first conductive member and the housing structure are electrically connected to each other;

the second electrode contact is clamped between the second conductive member and the third conductive member, wherein the second electrode contact, the second conductive member and the third conductive member are electrically connected to each other;

the battery supplies power to the heating member through the first electrode contact and the second electrode contact.

Further, the first conductive member includes a first conductive body and a first abutting portion protruding outwardly from the first conductive body along the radial direction of the first conductive body, the upper end surface of the first abutting portion abuts against the lower end surface of the second limiting portion; the lower surface of the second limiting portion is provided with a first receiving groove, the first electrode contact is clamped between the first receiving groove and the upper end surface of the first abutting portion.

Further, the outer surface of the first conductive body is provided with a second receiving groove extending downward from the upper end surface of the first conductive body to the upper end surface of the first abutting portion along the axial direction of the first conductive member, the first electrode contact passes through the second receiving groove and is clamped between the first receiving groove and the upper end surface of the first abutting portion.

Further, the first conductive member further includes a second abutting portion formed at the lower end of the first conductive body and protruding outwardly along the radial direction of the first conductive body, the lower end of the insulating member protrudes outwardly along the radial direction of the insulating member to form a third abutting portion, the first conductive member is provided with a mounting opening extending through the upper end surface and the lower end surface of the first conductive member, the insulating member is at least partially installed in the mounting opening, the upper end surface of the third abutting portion abuts against the lower end surface of the second abutting portion.

Further, the insulating member is provided with an assembling hole extending through the upper end surface and the lower end surface of the insulating member, the second conductive member is at least partially installed in the assembling hole, the lower end of the second conductive member protrudes outwardly along the radial direction of the second conductive member to form a fourth abutting portion, the upper end surface of the fourth abutting portion abuts against the lower end surface of the third abutting portion.

Further, the lower end surface of the second conductive member is provided with a mounting hole, the upper end surface of the second conductive member is provided with an insertion hole in communication with the mounting hole, the inner diameter of the mounting hole is larger than the inner diameter of the insertion hole, so that a limiting step is formed at the junction between the mounting hole and the insertion hole, the third conductive member is at least partially installed in the mounting hole, the second electrode contact passes through the insertion hole and is clamped between the limiting step and the upper end surface of the third conductive member.

Further, the upper end of the second conductive member is further provided with a groove, the groove is formed on the upper end surface of the second conductive member by recessing gradually downwardly along the radial direction of the second conductive member from the outer edge toward the center of the second conductive member, the insertion hole is located at the center of the bottom of the groove.

Further, the lower end of the battery housing is provided with a mounting groove, the battery device further includes a base structure connected to the lower end of the battery housing, the base structure includes a base installed at the lower end of the mounting groove, a first electrode contact member provided in the base, and a second electrode contact member provided in the base, the atomizer is installed on the base.

Further, the lower end of the battery housing protrudes outward to form a connecting shaft, the connecting shaft is provided with a leading hole passing through the connecting shaft, the leading hole communicates with the interior of the battery housing, the lead lines of the battery pass through the leading hole in the connecting shaft to enter the base, one of the lead lines is electrically connected to the first electrode contact member, and the other lead line is electrically connected to the second electrode contact member, the first electrode contact member is electrically connected to the first conductive member and/or the housing structure through the base, the second electrode contact member is electrically connected to the second conductive member and/or the third conductive member.

Further, the base is rotatable around the connecting shaft relative to the battery housing, the upper surface of the base is provided with a sealing wall; when the base rotates to one side relative to the battery housing, the mounting groove is exposed, and the atomizer is exposed to the outside; when the base rotates to the other side relative to the battery housing, the atomizer is driven by the base to enter into the mounting groove and the mounting groove is covered by the sealing wall.

The beneficial effects of the present disclosure are: in the atomizer and/or the electronic cigarette provided by the present disclosure, the first electrode contact is clamped between the first conductive member and the housing structure, and the first electrode contact, the first conductive member and the housing structure are electrically connected to each other; the second electrode contact is clamped between the second conductive member and the third conductive member, and the second electrode contact, the second conductive member and the third conductive member are electrically connected to each other. In the atomizer and/or the electronic cigarette provided by the present disclosure, each of the first electrode contact and the second electrode contact is electrically connected on both sides, thereby increasing the conductive range of the first electrode contact and the second electrode contact to maintain the stability of the electrical connection.

BRIEF DESCRIPTION OF THE DRAWINGS

Exemplary embodiments of the present disclosure are described more fully hereinafter with reference to the accompanying drawings.

Figure 1:
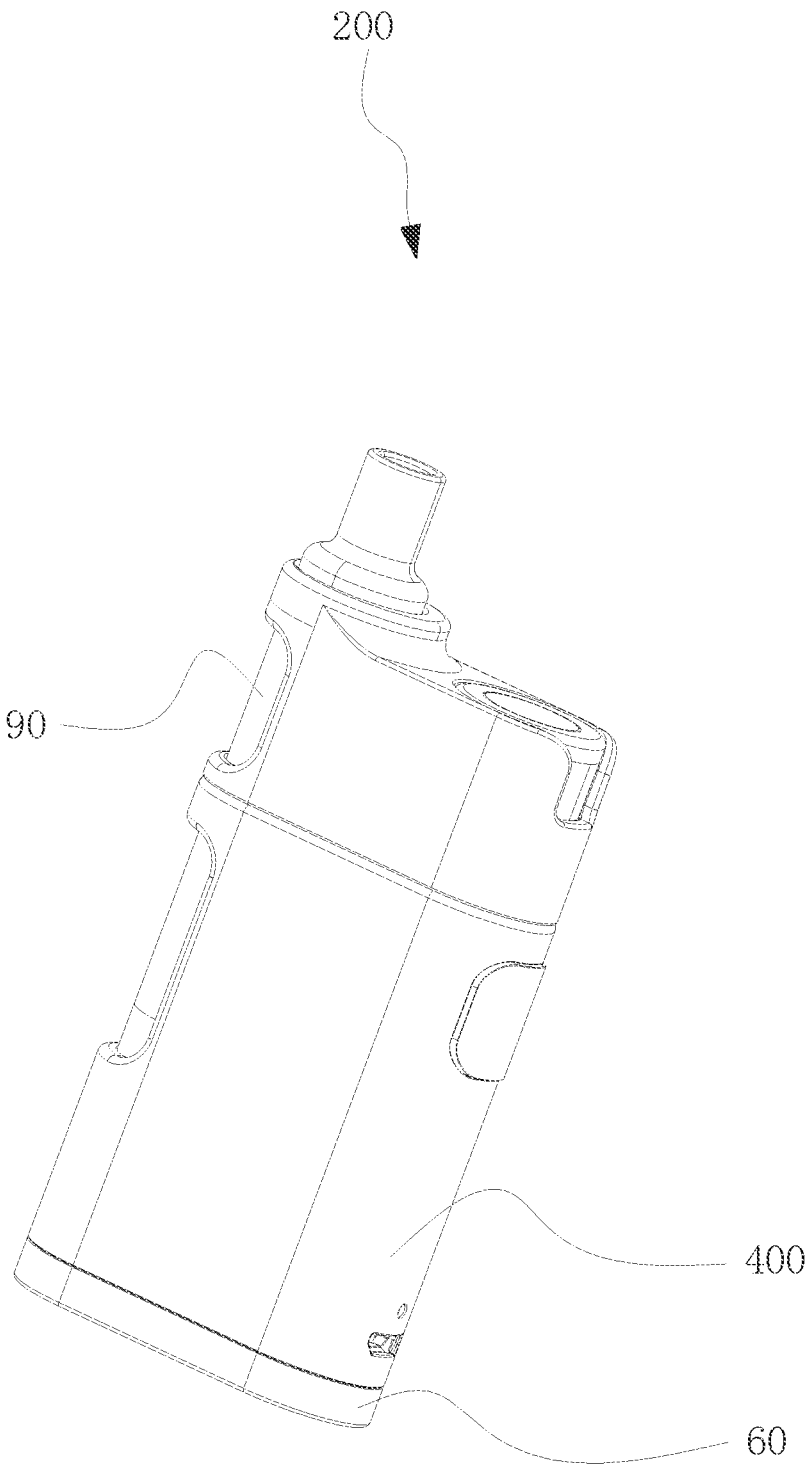
FIG. 1 is a schematic diagram of the electronic cigarette of the present disclosure.

The following table lists various components and reference numerals thereof.

| | |
|---|---|
| atomizer 100 | housing structure 10 |
| first housing 11 | second housing 12 |
| opening 123 | heat conducting member 21 |
| main body 221 | first electrode contact 222 |
| first bending end 2222 | second electrode end 2231 |
| second conductive member 32 | insulating member 33 |
| first abutting portion 312 | second abutting portion 313 |
| fourth abutting portion 322 | heating member 22 |
| assembling hole 332 | second receiving groove 314 |
| first receiving groove 124 | battery device 400 |
| base structure 60 | battery structure 70 |
| placement hole 42 | mounting groove 43 |
| retaining ring 46 | battery 71 |
| button 74 | USB interface 75 |
| placement aperture 53 | filtering base 91 |
| feeding seat 81 | feeding cover 82 |
| resisting portion 822 | base 61 |
| second electrode contact member 64 | third insulating member 65 |
| Sealing wall 611 | guiding protrusion 6111 |
| sliding protrusion 613 | stopping hole 614 |
| electrode opening 631 | first electrode end 641 |
| electronic cigarette 200 | connecting shaft 47 |
| heating structure 20 | connecting structure 30 |
| second limiting portion 121 | limiting groove 122 |
| cavity 211 | storing groove 212 |
| second electrode contact 223 | first electrode end 2221 |
| second bending end 2232 | first conductive member 31 |
| third conductive member 34 | first conductive body 311 |
| third abutting portion 331 | groove 321 |
| mounting hole 323 | insertion hole 324 |
| mounting opening 315 | first limiting portion 111 |
| battery housing 40 | feeding housing 50 |
| feeding structure 80 | observation opening 41 |
| guiding groove 44 | sliding groove 45 |
| PCB board 72 | lighting member 73 |
| observation hole 51 | placement opening 52 |
| filtering member 90 | light transmitting member 92 |

-continued

| | |
|---|---|
| feeding member 83 | sealing cover 84 |
| first electrode contact member 62 | second insulating member 63 |
| bottom cover 66 | bottom plate 67 |
| bump 612 | connecting groove 617 |
| electrode groove 615 | insulating groove 616 |
| second electrode end 642 | locking groove 651 |
| leading hole 48 | |

DETAILED DESCRIPTION OF PREFERRED EMBODIMENTS

The present disclosure will now be described in detail with reference to the drawings. These drawings are simplified schematic diagrams, which only illustrate the basic structure of the present disclosure in a schematic way, so it only shows the construction related to the present disclosure.

Referring to FIGS. 1 to 6, the present disclosure provides an electronic cigarette 200. The electronic cigarette 200 includes an atomizer 100 and a battery device 400 electrically connected to the atomizer 100.

Figure 7:
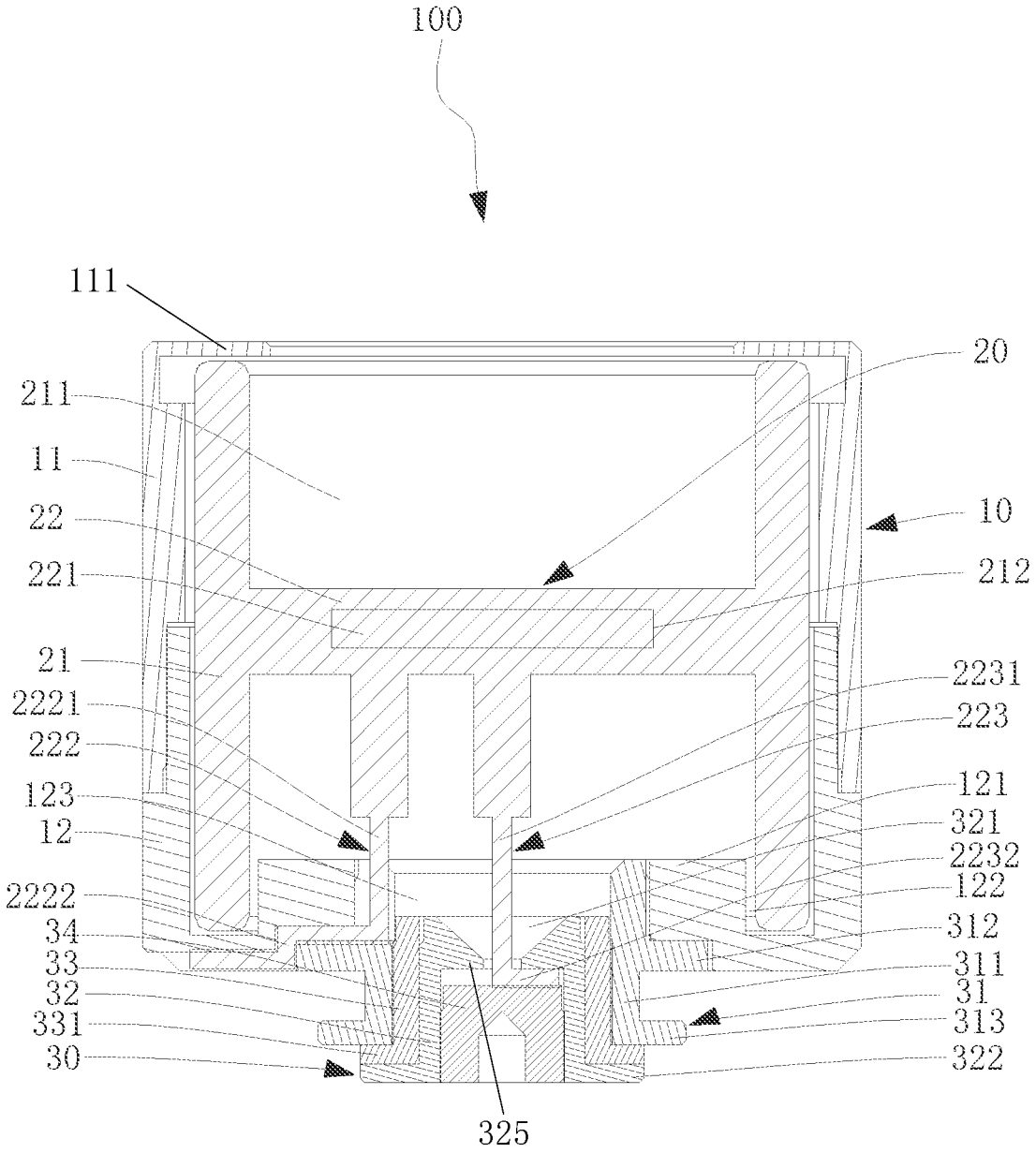
FIG. 7 is a schematic diagram of the atomizer of the electronic cigarette shown in FIG. 1.
Figure 8:
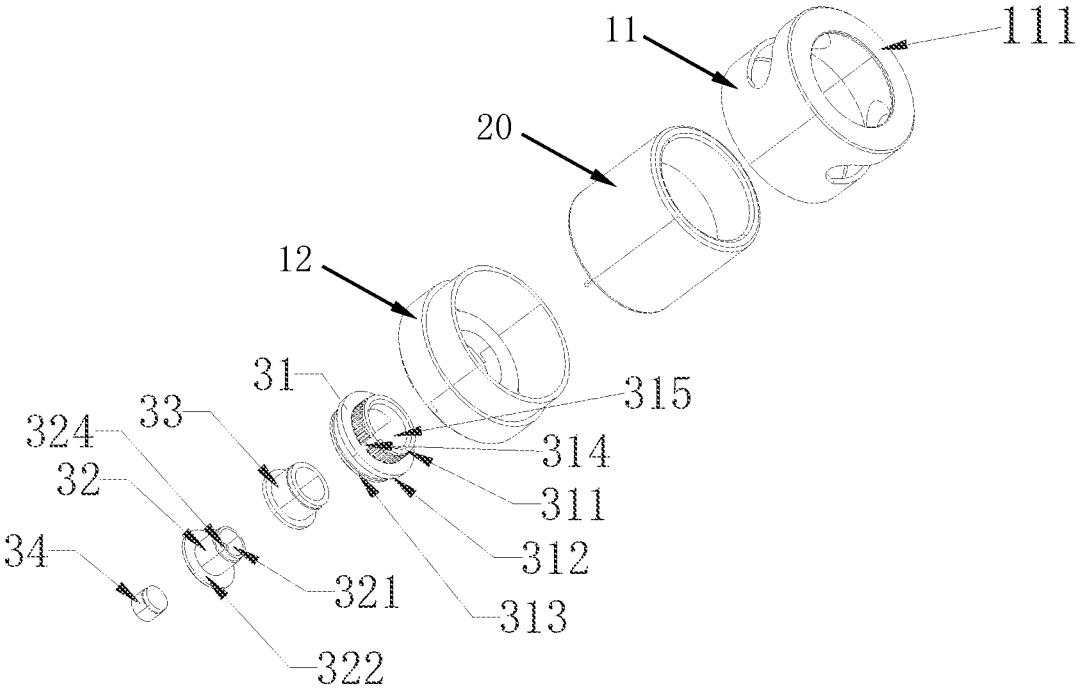
FIG. 8 is an exploded view of the atomizer shown in FIG. 7.
Figure 9:
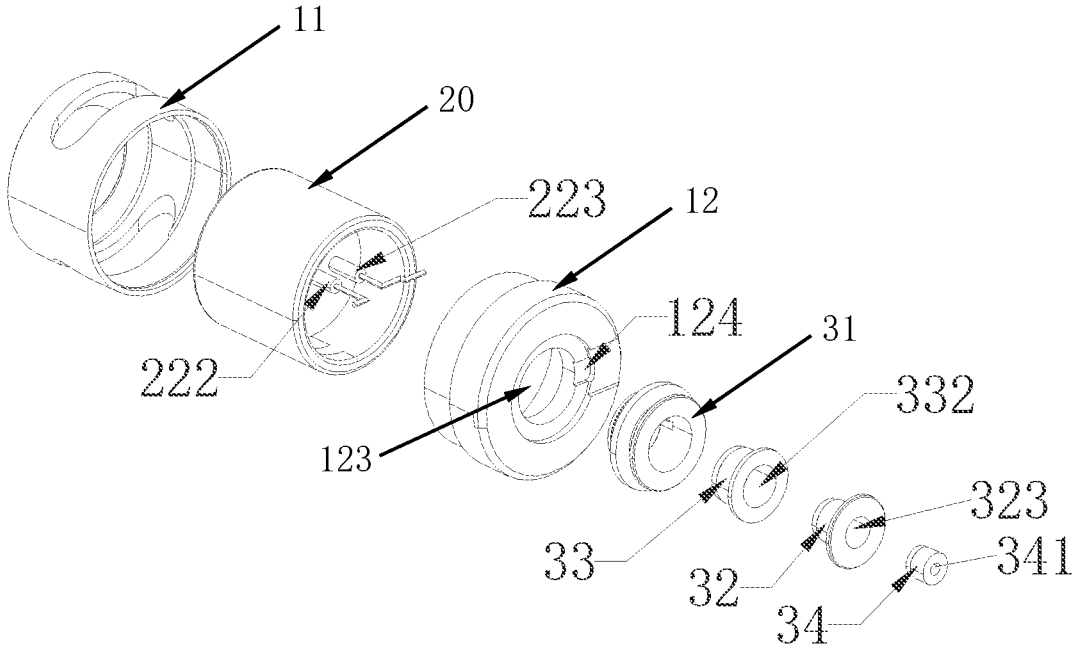
FIG. 9 is another exploded view of the atomizer shown in FIG. 7.

Please also refer to FIGS. 7 to 9, the atomizer 100 includes a housing structure 10, a heating structure 20 installed in the housing structure 10, a connecting structure 30 installed at one end of the housing structure 10, and a tobacco product arranged in the heating structure 20.

The housing structure 10 includes a first housing 11 and a second housing 12 connected to one end of the first housing 11. Both the first housing 11 and the second housing 12 are made of conductive materials. In this embodiment, both the first housing 11 and the second housing 12 are made of stainless steel. The connection methods of the first housing 11 and the second housing 12 include, but are not limited to, locking connection, screw connection, and magnetic connection. In this embodiment, the first housing 11 and the second housing 12 are connected in a locking connection. It can be understood that, in other embodiments not shown, the first housing 11 and the second housing 12 can be integrally formed.

The first housing 11 is substantially in the shape of a hollow cylinder, with the upper end and the lower end of the first housing 11 being opened. The upper end of the first housing 11 protrudes inwardly along a radial direction of the first housing 11 to form a first limiting portion 111.

The second housing 12 is substantially in the shape of a hollow cylinder, with the upper end and the lower end of the second housing 12 being opened. The lower end of the second housing 12 protrudes inwardly along the radial direction of the second housing 12 to form a second limiting portion 121. The upper surface of the second limiting portion 121 is recessed downward along the axial direction of the second housing 12 to form a limiting groove 122 for installing the heating structure 20. An opening 123 for installing the first conductive member 31 is formed and extends through the second limiting portion 121 from the upper surface to the lower surface of the second limiting portion 121. The lower surface of the second limiting portion 121 is provided with a first receiving groove 124 extending along the radial direction of the second housing 12 from the inner surface of the opening 123 to the outer surface of the second limiting portion 121.

The connecting structure 30 includes a first conductive member 31 at least partially received in the opening 123, a second conductive member 32 provided in the first conductive member 31, an insulating member 33 provided between the first conductive member 31 and the second conductive member 32, and a third conductive member 34 provided in the second conductive member 32. The first conductive member 31, the second conductive member 32 and the third conductive member 34 are all electrical conductors and are made of brass material. The insulating member 33 is made of PEEK (polyetheretherketone) material. It can be understood that, in other embodiments not shown, the first conductive member 31, the second conductive member 32 and the third conductive member 34 may also be made of metal conductive materials such as iron, cobalt, nickel, etc. The insulating member 33 may also be made of materials with good insulation and high temperature resistance.

The first conductive member 31 is substantially in the shape of a cylinder with two open ends. The first conductive member 31 includes a first conductive body 311, a first abutting portion 312 formed by protruding outwardly from the first conductive body 311 along the radial direction of the first conductive body 311, and a second abutting portion 313 formed at the lower end of the first conductive body 311 and protruding outwardly along the radial direction of the first conductive body 311. The outer surface of the first conductive body 311 is provided with a second receiving groove 314 extending downward from the upper end surface of the first conductive body 311 to the upper end surface of the first abutting portion 312 along the axial direction of the first conductive member 311. The second receiving groove 314 penetrates through the side wall of the first conductive body 311 along the radial direction of the first conductive member 311. The first conductive body 311 is at least partially installed in the opening 123. The upper end surface of the first abutting portion 312 abuts against the lower end surface of the second limiting portion 121. The first conductive member 31 is further provided with a mounting opening 315 extending through the upper end surface and the lower end surface of the first conductive member 31.

The insulating member 33 is substantially in the shape of a cylinder with two open ends. The lower end of the insulating member 33 protrudes outwardly along the radial direction of the insulating member 33 to form a third abutting portion 331 for abutting against the second abutting portion 313. The insulating member 33 is at least partially installed in the mounting opening 315. The upper end surface of the third abutting portion 331 abuts against the lower end surface of the second abutting portion 313. The insulating member 33 is further provided with an assembling hole 332 extending through the upper end surface and the lower end surface of the insulating member 33.

The second conductive member 32 is substantially in the shape of a cylinder with two open ends. The lower end of the second conductive member 32 protrudes outwardly along the radial direction of the second conductive member 32 to form a fourth abutting portion 322 for abutting against the lower end surface of the third abutting portion 331. The lower end surface of the second conductive member 32 is provided with a mounting hole 323 for mounting the third conductive member 34. The upper end surface of the second conductive member 32 is provided with an insertion hole 324 in communication with the mounting hole 323. The inner diameter of the mounting hole 323 is larger than the inner diameter of the insertion hole 324, so that a limiting step 325 is formed at the junction between the mounting hole 323 and the insertion hole 324. The upper end of the second conductive member 32 is further provided with a groove 321. The groove 321 communicates with the insertion hole 324. The groove 321 is formed on the upper end surface of the second conductive member 32 by recessing gradually downwardly along the radial direction of the second conductive member 32 from the outer edge toward the center of the second conductive member 32. The insertion hole 324 is located at the center of the bottom of the groove 321. In this embodiment, the connecting lines of various points from the outer edge of the groove 321 to the center of the groove 321 along the radial direction of the second conductive member 32 are straight lines, and the angles between the straight lines and the axis of the second conductive member 32 are the same. It can be understood that, the inner surface of the groove 321 is a conical surface. The second conductive member 32 is at least partially installed in the assembling hole 332. The upper end surface of the fourth abutting portion 322 abuts against the lower end surface of the third abutting portion 331.

The third conductive member 34 is substantially columnar. The third conductive member 34 is at least partially installed in the mounting hole 323, and the third conductive member 34 abuts against the limiting step 325. The lower end surface of the third conductive member 34 is provided with a pressing hole 341, and the pressing hole 341 is a blind hole. On the one hand, the pressing hole 341 facilitates positioning and clamping of the third conductive member 34 by a fixture (not shown). On the other hand, the side wall of the third conductive member 34 at the position of the pressing hole 341 has a deformation space. During installation, a force can be applied outwardly to the pressing hole 341 along the radial direction of the third conductive member 34, so that the side wall of the third conductive member 34 at the position of the pressing hole 341 is deformed outwardly along the radial direction of the third conductive member 34. Therefore, the installation of the third conductive member 34 and the mounting hole 323 are installed more firmly.

The heating structure 20 includes a heat conducting member 21 received in the first housing 11 and the second housing 12, and a heating member 22 installed in the heat conducting member 21. The upper end surface of the heating structure 20 abuts against the lower end surface of the first limiting portion 111, and the lower end surface of the heating structure 20 abuts against the upper end surface of the second limiting portion 121.

The heat conducting member 21 is substantially cylindrical. The upper end of the heat conducting member 21 is recessed downwardly to form a cavity 211 for placing a tobacco product. The bottom wall at the lower end of the cavity 211 is provided with a storing groove 212 for placing the heating member 22. The upper end surface of the heat conducting member 21 abuts against the lower end surface of the first limiting portion 111. The lower end of the heat conducting member 21 is disposed in the limiting groove 122 and abuts against the bottom wall of the limiting groove 122. The heat conducting member 21 is made of glass material. It can be understood that, in other embodiments not shown, the heat conducting member 21 may also be made of materials with good thermal conductivity such as iron and aluminum.

The heating member 22 is installed in the storing groove 212. The heating member 22 includes a main body 221 disposed in the storing groove 212, and a first electrode contact 222 and a second electrode contact 223 both of which are configured for electrically connecting with the main body 221. The first electrode contact 222 includes a first electrode end 2221 and a first bending end 2222. One end of the first electrode end 2221 is electrically connected to the main body 221. The width of the second receiving groove 314 is greater than the transverse size of the first electrode end 2221. The other end of the first electrode end 2221 extends through the second receiving groove 314 to the lower end of the second limiting portion 121. One end of the first bending end 2222 is connected to the first electrode end 2221. The other end of the first bending end 2222 is clamped between the first receiving groove 124 and the upper end surface of the first abutting portion 312. The second electrode contact 223 includes a second electrode end 2231 and a second bending end 2232. One end of the second electrode end 2231 is connected to the main body 221. The inner diameter of the insertion hole 324 is greater than the transverse size of the second electrode end 2231. The other end of the second electrode end 2231 extends through the insertion hole 324 to the lower end surface of the limiting step 325. One end of the second bending end 2232 is connected to the second electrode end 2231. The other end of the second bending end 2232 is clamped between the limiting step 325 and the upper end surface of the third conductive member 34. The heating member 22 is made of a metallic conductive material, such as nickel-chromium alloy, tungsten, steel, and the like. In this embodiment, the heat conducting member 21 and the heating member 22 are integrally formed.

In use, the tobacco product is placed in the cavity 211, after the circuit is turned on, as the temperature of the heating member 22 increases, the heating member 22 begins to conduct heat to the heat conducting member 21. The heat conducting member 21 heats the tobacco product placed in the cavity 211, so that the tobacco product is atomized to form smoke that can be inhaled.

Please refer to FIGS. 1-3 again, the battery device 400 includes a battery housing 40, a battery structure 70 received in the battery housing 40, a feeding housing 50 connected to the upper end of the battery housing 40, a feeding structure 80 received in the feeding housing 50, and a base structure 60 connected to the lower end of the battery housing 40 for installing the atomizer 100.

Figure 10:
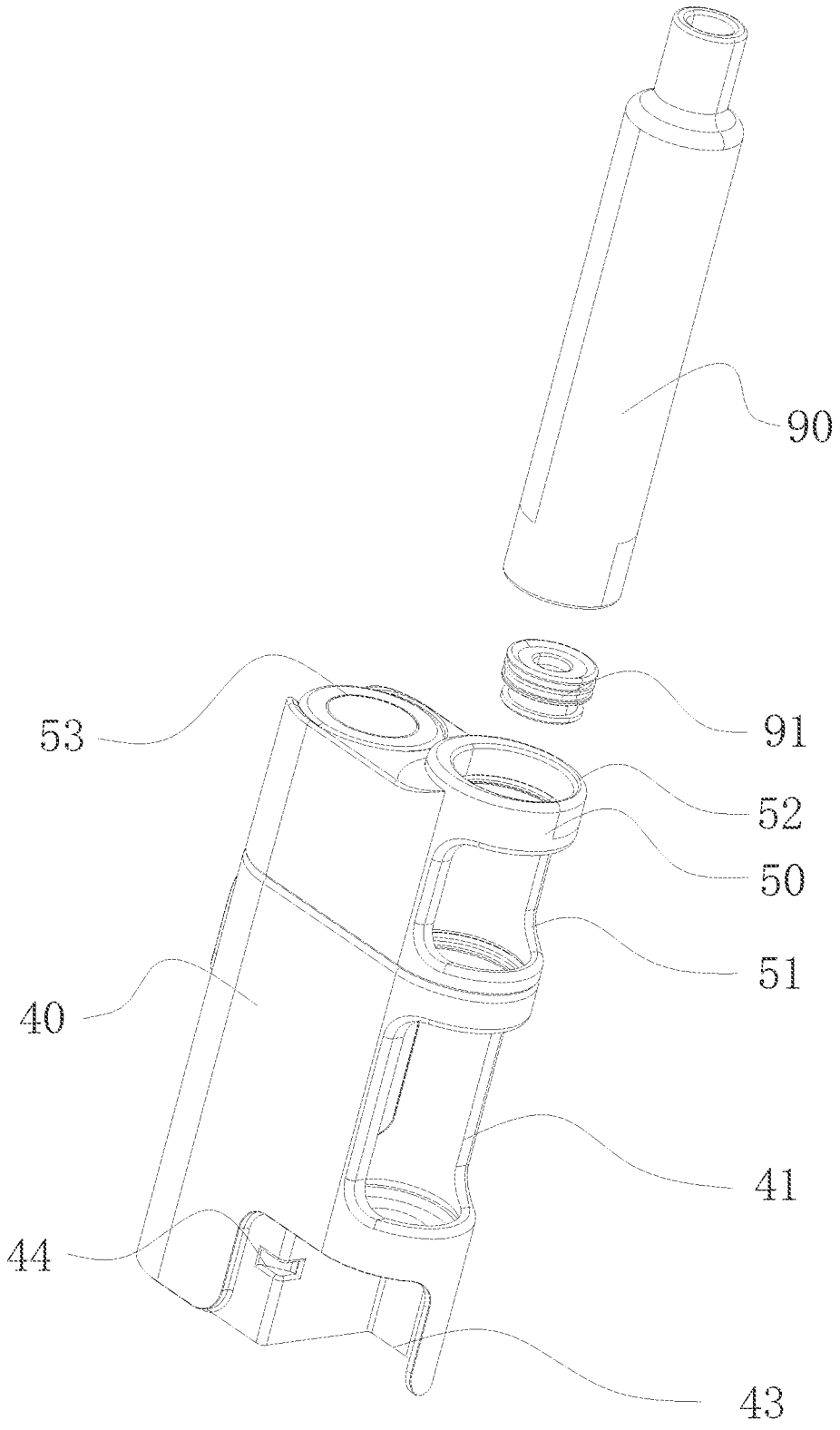
FIG. 10 is a partially exploded view of the electronic cigarette (except the atomizer) shown in FIG. 1.
Figure 11:
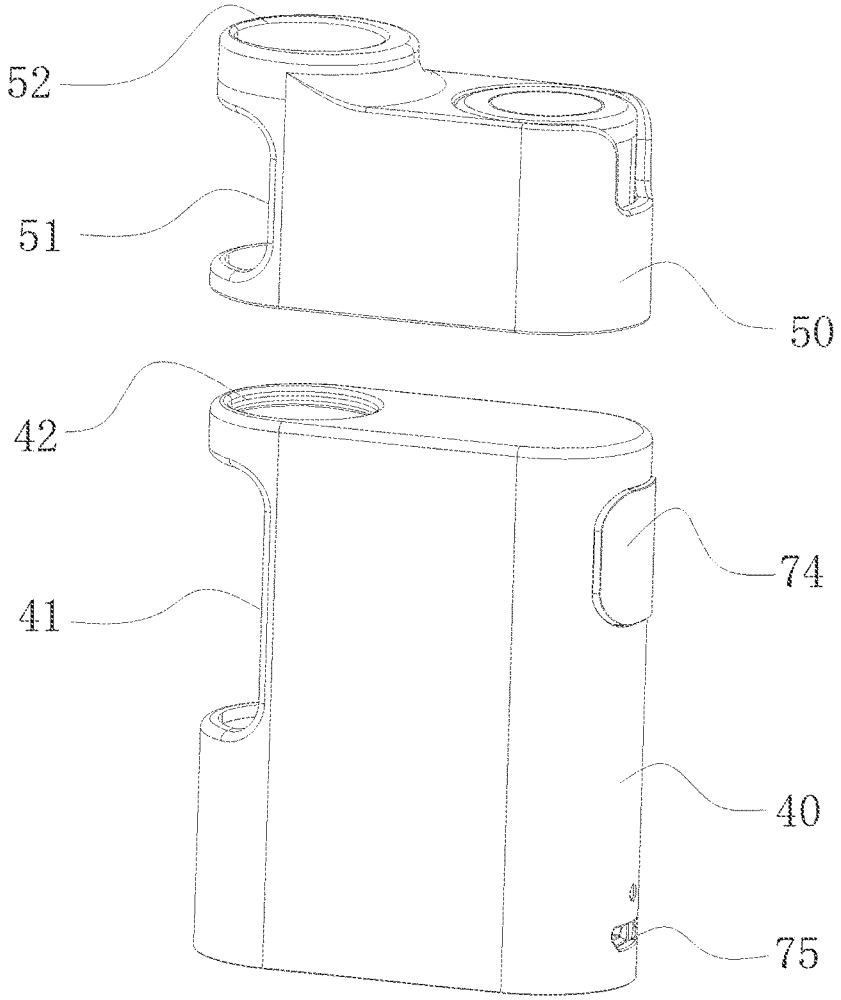
FIG. 11 is a schematic diagram of the matching relationship between the battery housing and the feeding housing in the electronic cigarette shown in FIG. 1.
Figure 12:
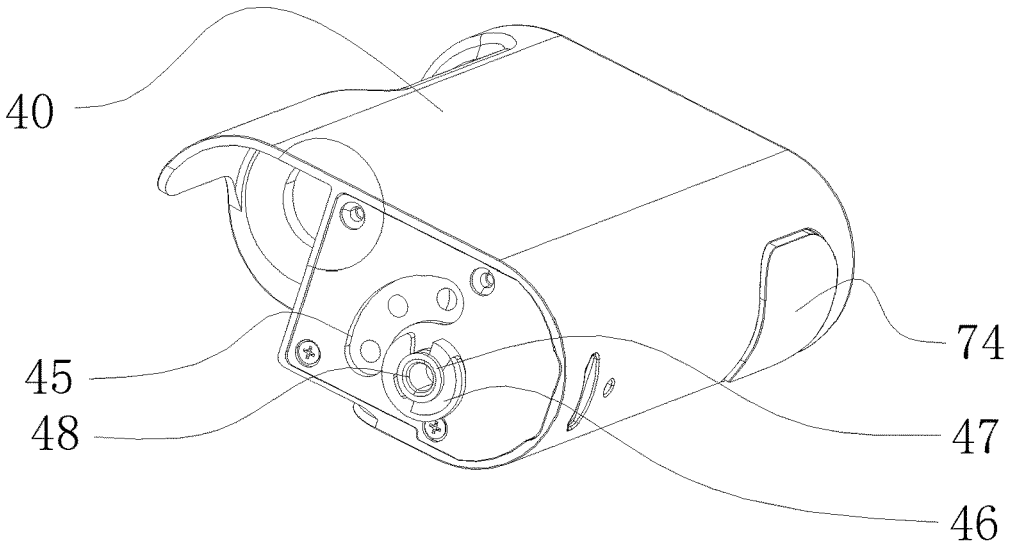
FIG. 12 is a schematic diagram of the battery housing of the electronic cigarette shown in FIG. 1.

Please refer to FIGS. 10-12 at the same time, the side of the battery housing 40 is provided with an observation opening 41. The upper end of the battery housing 40 is provided with a placement hole 42 that extends to the lower end of the battery housing 40. The placement hole 42 is in communication with the observation opening 41. The lower end of the battery housing 40 is provided with a mounting groove 43 in communication with the observation opening 41 for installing the atomizer 100. The inner wall of the mounting groove 43 is provided with a guiding groove 44 for connecting with the base structure 60. The lower end of the battery housing 40 is provided with a sliding groove 45 at one side away from the mounting groove 43. The sliding groove 45 is arc-shaped. The lower end of the battery housing 40 protrudes outward at the center of the arc to form a connecting shaft 47. The connecting shaft 47 is provided with a leading hole 48 passing through the connecting shaft 47. The leading hole 48 communicates with the interior of the battery housing 40.

Please refer to FIGS. 4-6 again, the battery structure 70 includes a battery 71 received in the battery housing 40, a PCB (Printed Circuit Board) board 72 connected to the battery 71, and two lighting members 73. The battery 71, the PCB board 72 and the two lighting members 73 are all arranged on one side of the battery housing 40 away from the observation opening 41. The two lighting members 73 can be lamp beads, LEDs (light emitting diode), and the like. The PCB board 72 is arranged on one side of the battery 71 away from the observation opening 41. One of the lighting members 73 is arranged on one side of the battery 71 adjacent to the observation opening 41, and the other lighting member 73 is arranged on one side of the PCB board 72 away from the battery 71. In this embodiment, the battery structure 70 further includes at least one button 74 arranged on one side of the battery housing 40 away from the observation opening 41 and connected to the PCB board 72, and a USB (universal serial bus) interface 75 arranged on one side of the lower end of the battery housing 40 away from the mounting groove 43. One of the buttons 74 can be used to control the turning on or off of the battery device 400 for supplying power to the atomizer 100. One of the buttons 74 can be used to control the turning on or off of one of the lighting members 73. One of the buttons 74 can be used to control the turning on or off of the other lighting member 73. One of the buttons 74 can be used to control the increase or decrease of the output power of the battery device 400 to the atomizer 100. It can be understood that the function and number of the buttons 74 are not limited, and can be set according to the control requirements of the battery device 400.

The feeding housing 50 and the battery housing 40 are two independent parts, which can be detachably connected by means of clamping connection, plug connection, magnetic connection, etc. In this embodiment, the feeding housing 50 and the battery housing 40 are connected by a magnetic connection. It can be understood that in other embodiments not shown, the feeding housing 50 and the battery housing 40 may also be integrally formed. One side of the feeding housing 50 is provided with an observation hole 51. The upper end of the feeding housing 50 is provided with a placement opening 52 that extends the lower end of the feeding housing 50 and communicates with the placement hole 42. A placement aperture 53 is provided on one side of the feeding housing 50 far away from the placement opening 52. The cavity enclosed by the inner wall of the placement aperture 53 forms a placement cavity (not labelled) for installing the feeding structure 80.

In this embodiment, a filtering base 91 and a filtering member 90 are disposed in the placement hole 42. The filtering base 91 is made of a soft material with good sealing properties such as silicone. The filtering base 91 is installed at the connecting position between the placement hole 42 and the mounting groove 43. The filtering base 91 abuts against the inner wall of the placement hole 42. The inner cavity of the filtering member 90 is filled with a base material such as water, juice, red wine, milk, etc. One end of the filtering member 90 abuts against the filtering base 91, and the other end of the filtering member 90 passes through the placement hole 42 and extends to the outside of the placement opening 52.

In this embodiment, a light transmitting member 92 made of silicone or the like is provided between the filtering member 90 and the battery housing 40. The light transmitting member 92 is located adjacent to the lighting member 73 provided on the side of the observation opening 41. On the one hand, the user can observe the base material in the inner cavity of the filtering member 90 through the observation opening 41 and the observation hole 51. Moreover, when the lighting member 73 on the side of the observation opening 41 is turned on, the bright light emitted by the lighting member 73 can be irradiated to the outside through the light transmitting member 92, and the user can observe the base material in the inner cavity of the filtering member 90 through the bright light irradiated to the outside. On the other hand, the light transmitting member 92 made of a soft material can prevent the filtering member 90 and the battery housing 40 from being rigidly contacted, and prevent the filtering member 90 and the battery housing 40 from being damaged due to rigid contact, which may affect the service life of the filtering member 90.

The feeding structure 80 includes a feeding seat 81 installed in the placement cavity. The feeding seat 81 is in the shape of a hollow cylinder with one end open. The feeding seat 81 is used for storing tobacco material. The feeding structure 80 further includes a feeding cover 82 installed in the opening at one end of the feeding seat 81, a sealing cover 84 installed on the feeding cover 82 away from the opening of the feeding seat 81, and a feeding member 83 installed on the sealing cover 84 for adding tobacco material. The feeding member 83 passes through the feeding cover 82 and extends into the feeding seat 81.

Both the feeding seat 81 and the feeding cover 82 are made of soft materials such as silicone. The feeding cover 82 and the feeding seat 81 are detachably connected by clamping connection, plugging connection, etc. It can be understood that, in other embodiments not shown, the feeding cover 82 may also be integrally formed with the feeding seat 81. The upper end of the feeding cover 82 protrudes outwardly along the circumferential direction of the feeding cover 82 to form a resisting portion 822 that abuts against the upper end of the feeding seat 81.

The feeding member 83 is disposed in a fixing hole (not labelled) provided in the feeding cover 82. The feeding member 83 is substantially in the shape of a spoon. The feeding member 83 is made of a material with high hardness. In this embodiment, the feeding member 83 is made of a glass material.

The sealing cover 84 is arranged in the resisting portion 822 to shield the feeding member 83. The sealing cover 84 and the resisting portion 822 are detachably connected by means of locking connection, plug connection, etc. In this embodiment, the sealing cover 84 is made of a metal material. When the user needs to add tobacco material, the user can remove the sealing cover 84 so that the feeding member 83 is exposed, and the user can take out the feeding member 83 for adding tobacco material. After the feeding member 83 has been added with the tobacco material, the user can install the sealing cover 84 in the resisting portion 822 to cover the feeding member 83 and protect the feeding member 83, and prevent external dirt from adhering to the feeding member 83. When the tobacco material is added, if the external dirt and the tobacco material are mixed, which will affect the user's smoking taste, and at the same time affect the user's physical health. It can be understood that since the feeding seat 81 and the feeding cover 82 are made of soft materials such as silicone, rigid contact between the feeding seat 81 and the inner wall of the placement cavity is avoided and the service life of the feeding seat 81 is increased, rigid contact between the feeding member 83 and the inner wall of the fixing hole is avoided and the service life of the feeding member 83 is increased.

Figure 13:
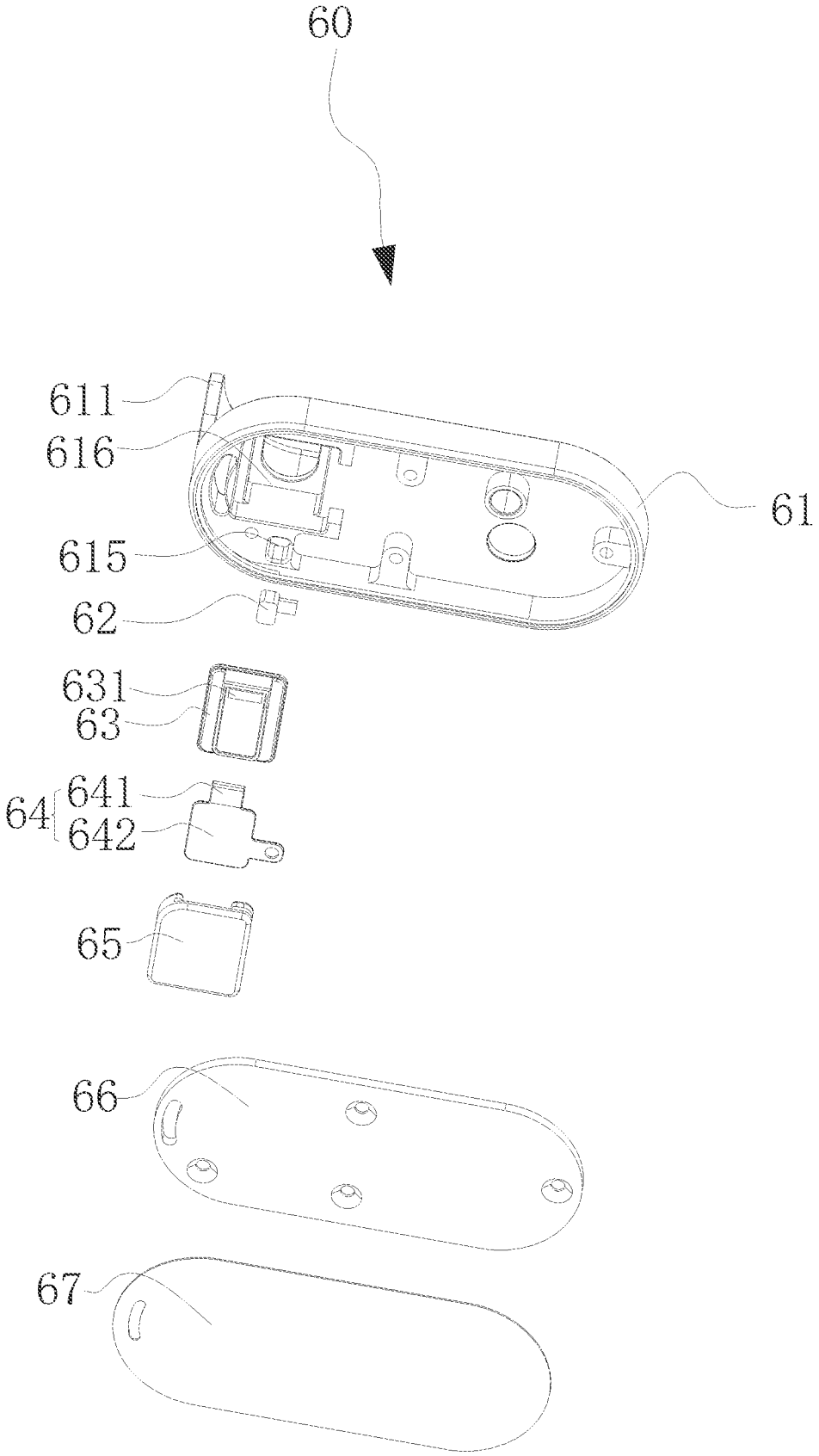
FIG. 13 is an exploded view of the base structure of the electronic cigarette shown in FIG. 1 from a view angle.
Figure 14:
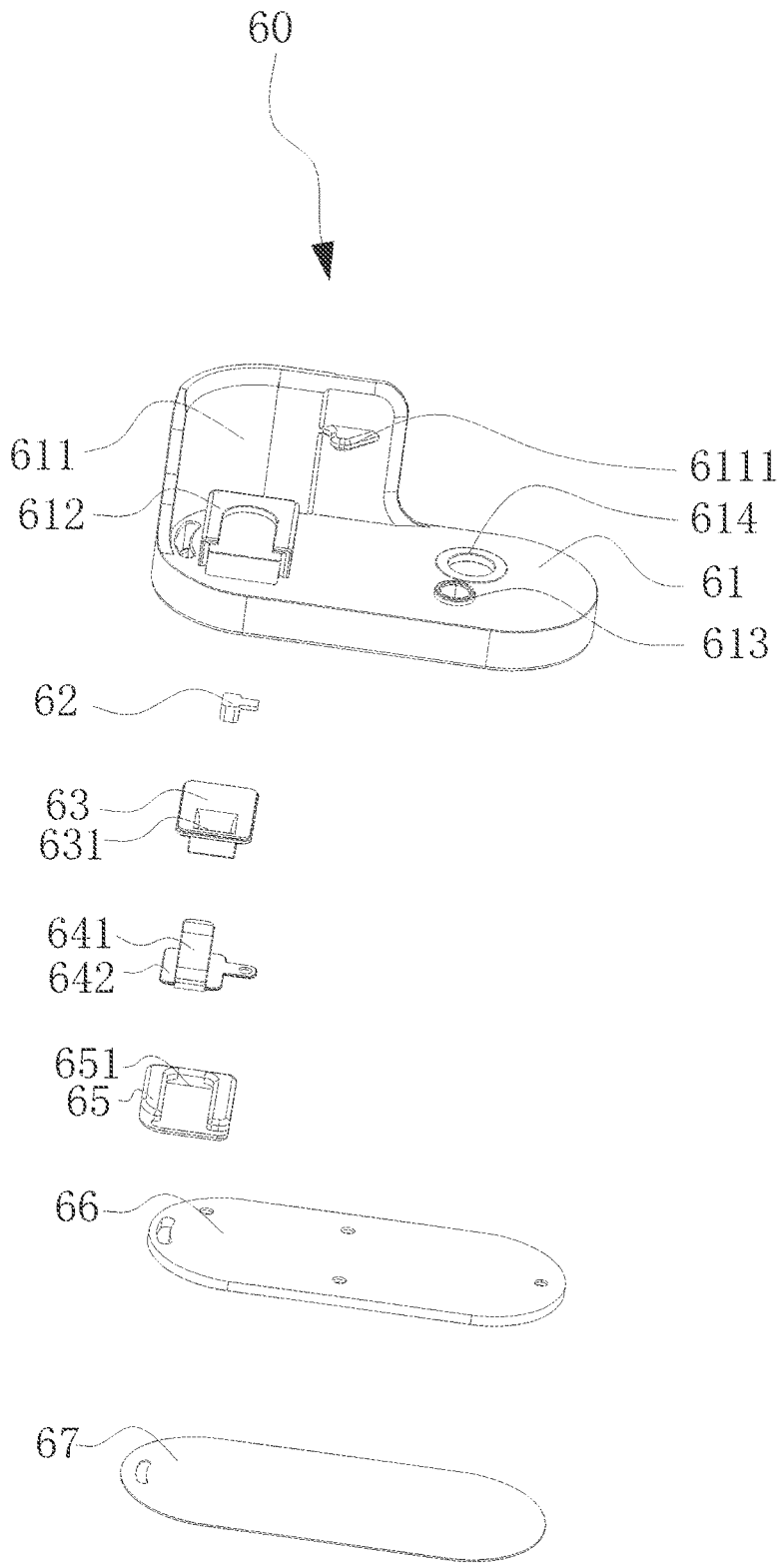
FIG. 14 is an exploded view of the base structure of the electronic cigarette shown in FIG. 1 from another view angle.
Figure 15:
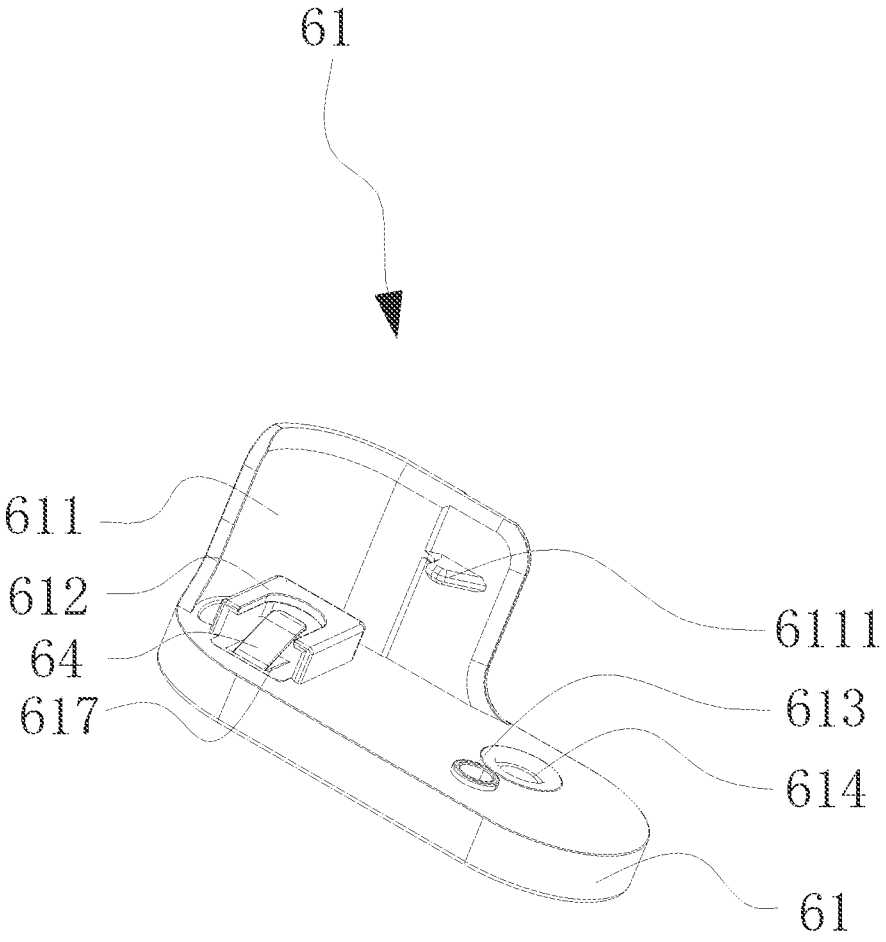
FIG. 15 is a schematic diagram of the base of the electronic cigarette shown in FIG. 1.

Please also refer to FIGS. 13 to 15, the base structure 60 includes a base 61 installed at the lower end of the mounting groove 43, a first electrode contact member 62 provided in the base 61, a second insulating member 63 provided in the base 61, a third insulating member 65 connected to the lower end of the second insulating member 63, a second electrode contact member 64 provided between the second insulating member 63 and the third insulating member 65, a bottom cover 66 connected to the lower surface of the base 61, and a bottom plate 67 provided on one side of the bottom cover 65 away from the base 61. In this embodiment, both the second insulating member 63 and the third insulating member 65 are made of insulating materials such as silicone and rubber.

The upper surface of the base 61 is provided with a sealing wall 611 for sealing the mounting groove 43. The sealing wall 611 is provided with a guiding protrusion 6111 corresponding to the guiding groove 44. The upper surface of the base 61 is provided with a bump 612 on one side of the sealing wall 611 and the bump 612 has an opening at one end. The base 61 is provided a connecting groove 617 corresponding to the bump 612 and used for the second electrode contact member 64 to pass therethrough. A sliding protrusion 613 corresponding to the sliding groove 45 and a stopping hole 614 corresponding to the connecting shaft 47 provided at the lower end of the battery housing 40 are provided at intervals on the upper surface of the base 61 and are located at one side away from the sealing wall 611. The connecting shaft 47 provided at the lower end of the battery housing 40 is inserted into the stopping hole 614. Therefore, the base 61 can rotate relative to the battery housing 40. The battery housing 40 further includes a retaining ring 46. The retaining ring 46 is connected to the connecting shaft 47. The retaining ring 46 is located at the lower surface of the base 61. The retaining ring 46 abuts against the lower surface of the base 61 to prevent the base 61 from axial movement relative to the connecting shaft 47. The lead lines of the battery structure 70 pass through the leading hole 48 in the connecting shaft 47 to enter the base 61. One of the lead lines is electrically connected to the first electrode contact member 62, and the other lead line is electrically connected to the second electrode contact member 64. In this embodiment, the lower surface of the base 61 is provided with an electrode groove 615 used for installing the first electrode contact member 62 and an insulating groove 616 spaced from the electrode groove 615 and used for installing the second insulating member 63. The insulating groove 616 communicates with the connecting groove 617.

The first electrode contact member 62 is installed in the electrode groove 615, and the first electrode contact member 62 is electrically connected to the base 61.

The second insulating member 63 is installed in the insulating groove 616, and an electrode opening 631 for installing the second electrode contact member 64 is provided in the second insulating member 63.

The second electrode contact member 64 includes a first electrode end 641 disposed in the electrode opening 631 and extending into the connecting groove 617, and a second electrode end 642 connected to the lower end of the first electrode end 641. The second electrode end 642 is disposed between the second insulating member 63 and the third insulating member 65.

The third insulating member 65 is provided with a locking groove 651 for installing the second electrode end 642.

The bottom cover 66 and the base 61 are two separate parts, and the two are detachably connected by a connection method such as a locking connection and a plug connection.

Figure 2:
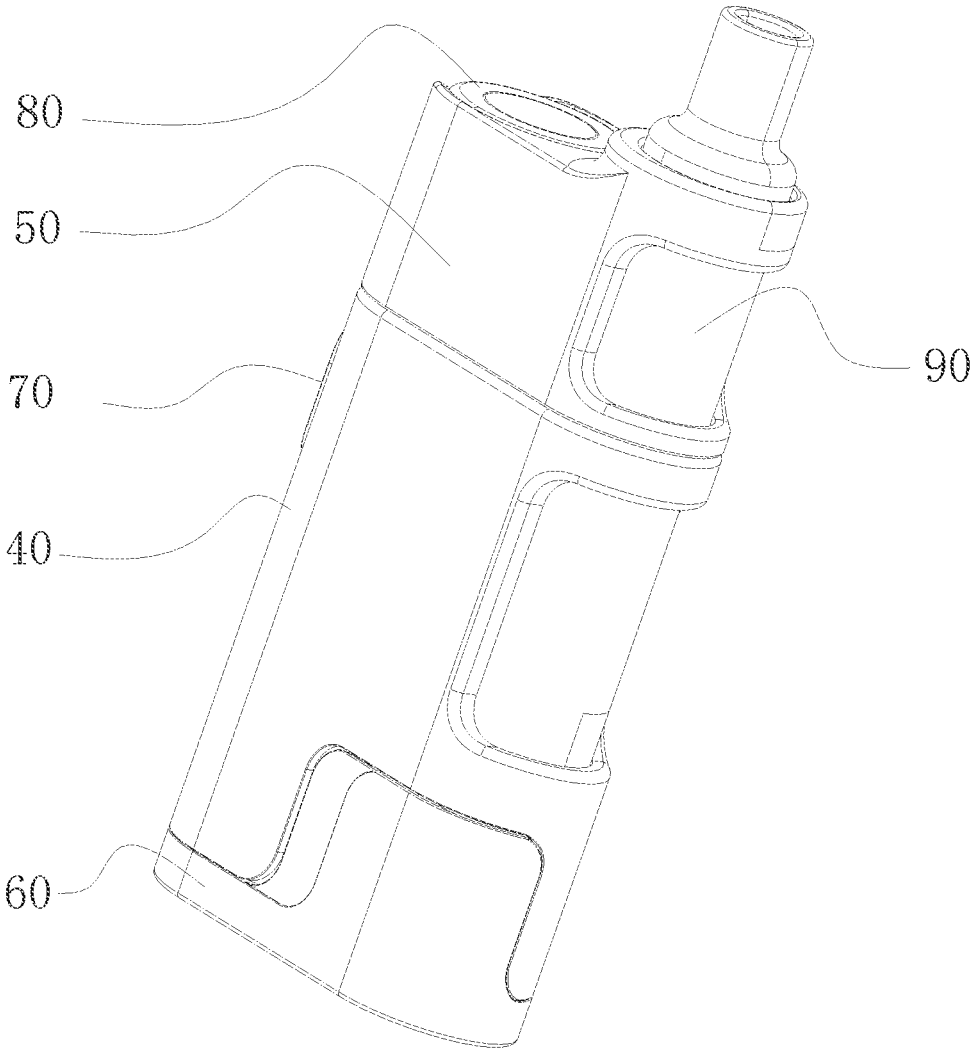
FIG. 2 is a schematic diagram of the electronic cigarette shown in FIG. 1 in one state.
Figure 3:
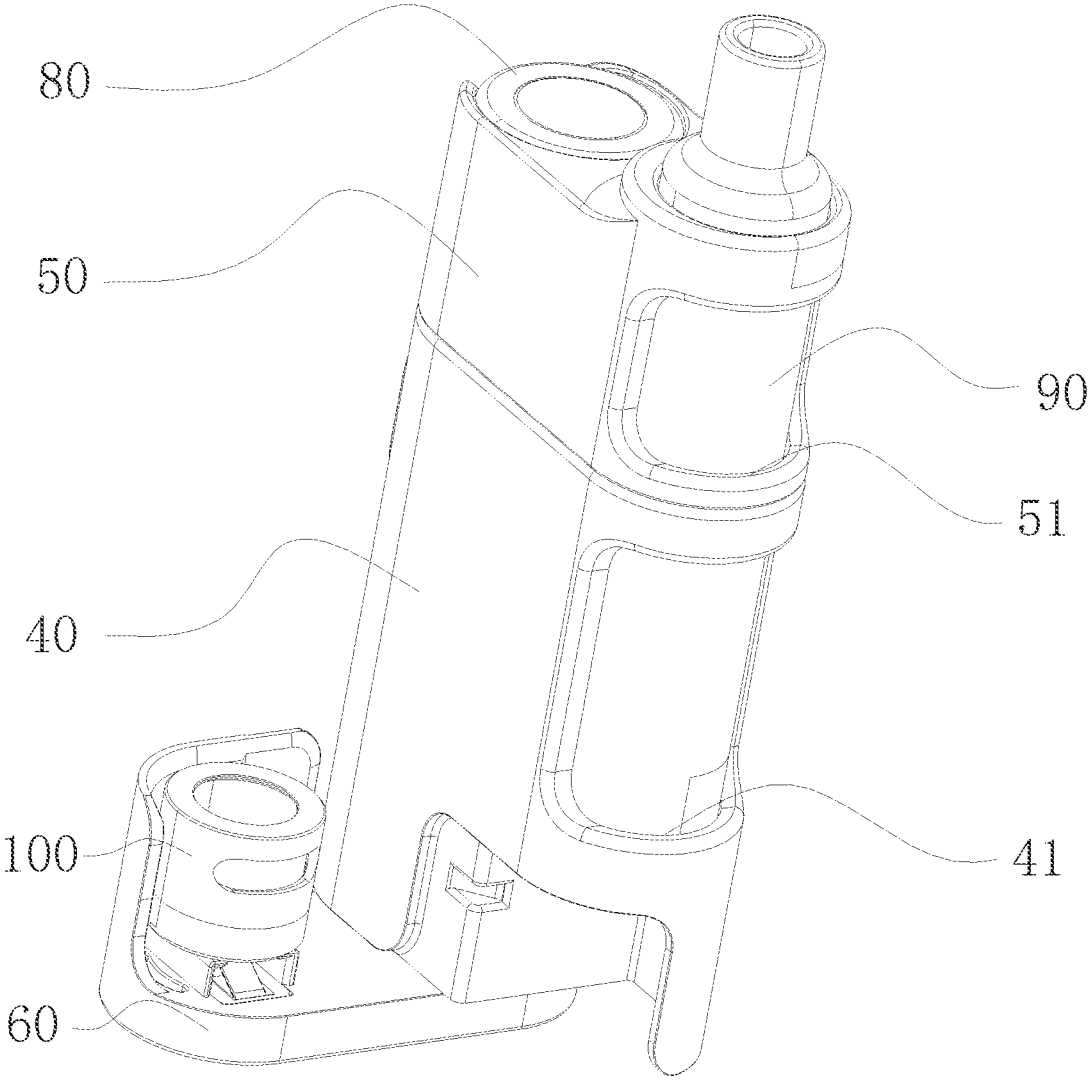
FIG. 3 is a schematic diagram of the electronic cigarette shown in FIG. 1 in another state.
Figure 4:
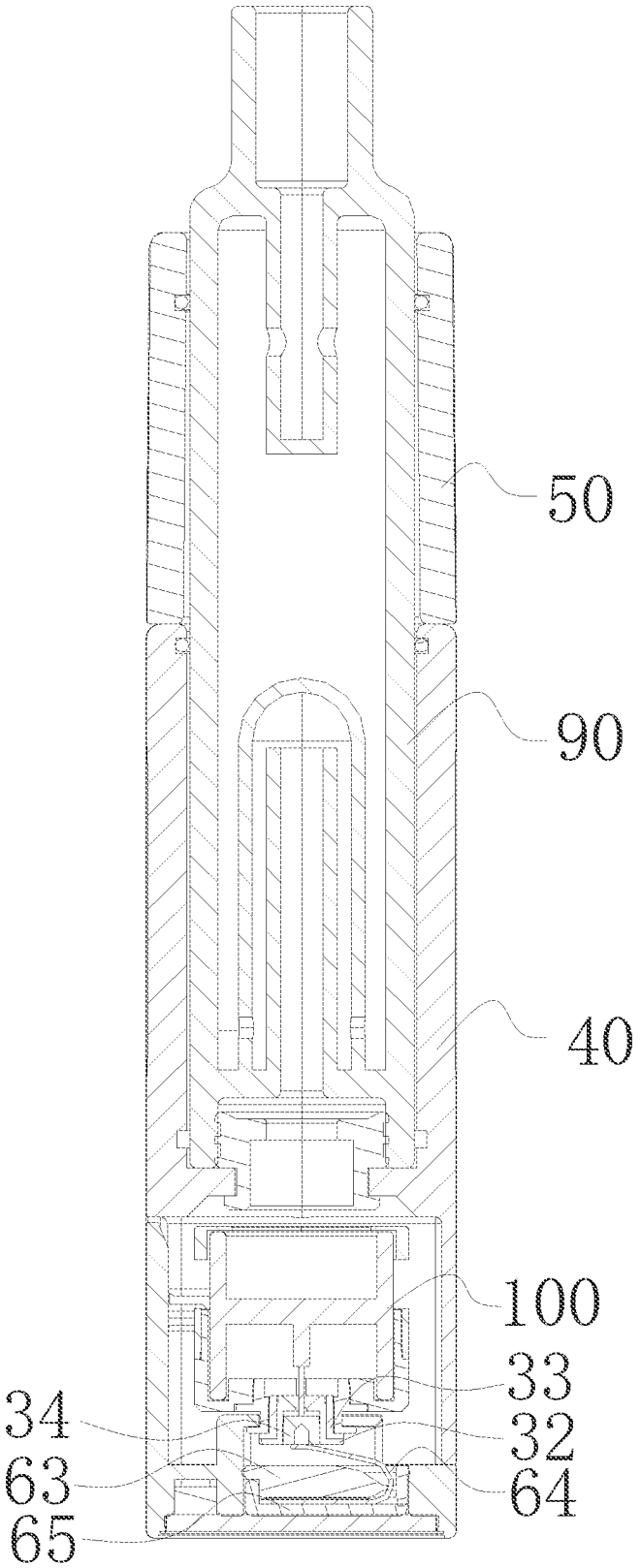
FIG. 4 is a cross-sectional view of the electronic cigarette shown in FIG. 1 from a view angle.
Figure 5:
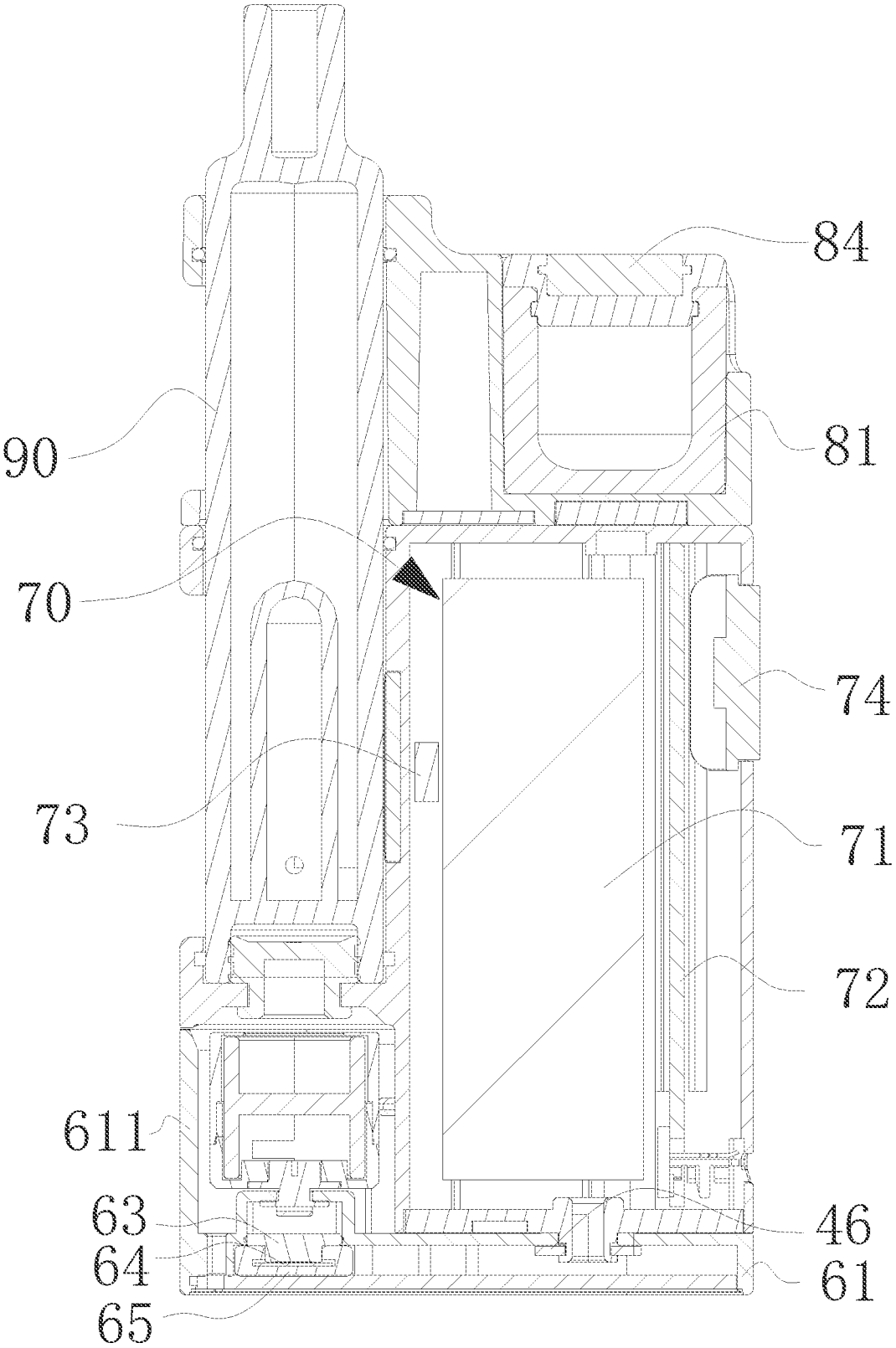
FIG. 5 is a cross-sectional view of the electronic cigarette shown in FIG. 1 from another view angle.
Figure 6:
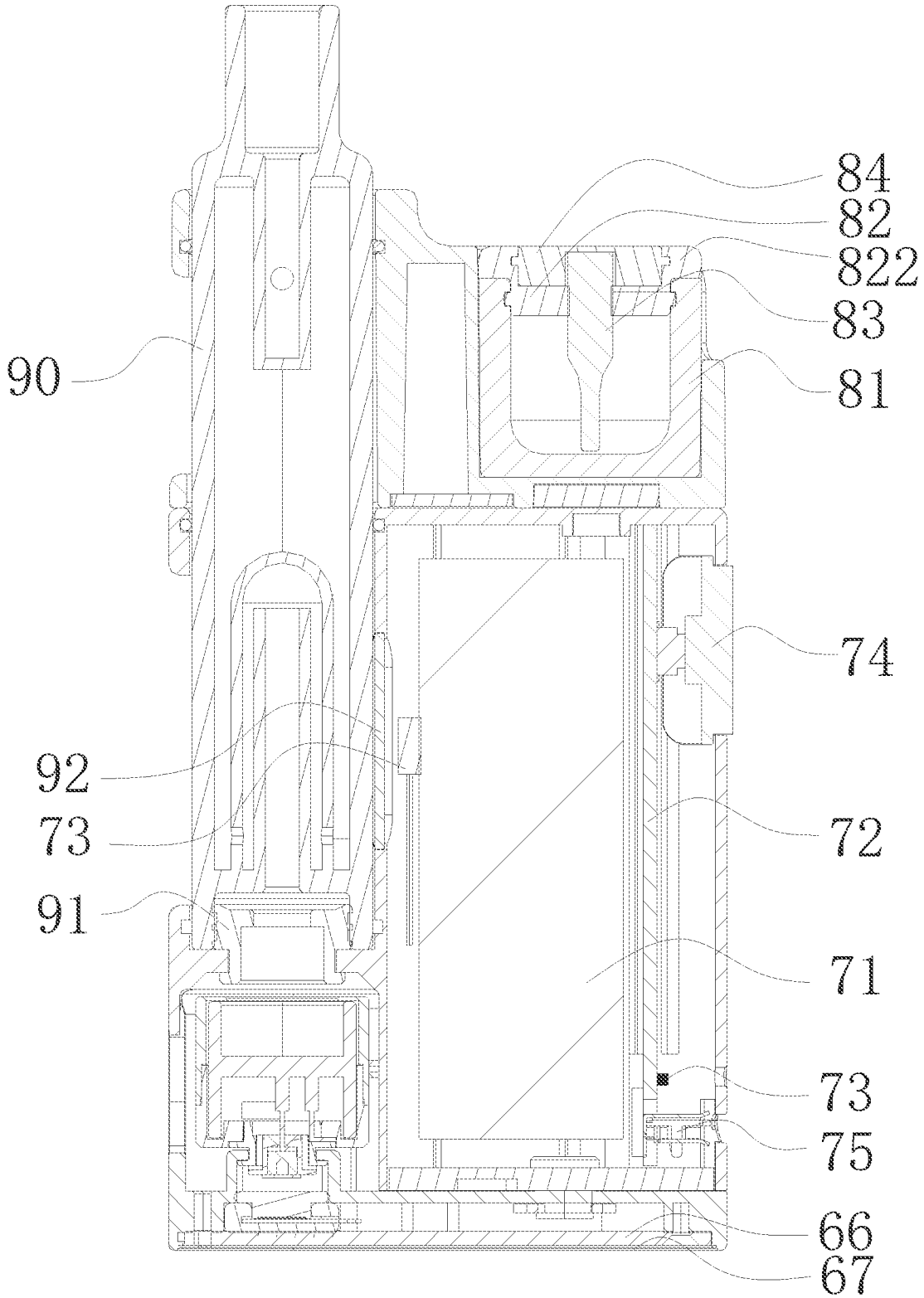
FIG. 6 is a cross-sectional view of the electronic cigarette shown in FIG. 1 from a further view angle.

In this embodiment, the atomizer 100 is installed on the bump 612, the first electrode contact member 62 is electrically connected to the first conductive member 31 and/or the housing structure 10 through the bump 612 of the base 61. The second electrode contact member 64 is electrically connected to the second conductive member 32 and/or the third conductive member 34. The sliding protrusion 613 of the base 61 engages in the sliding groove 45. When the base 61 rotates relative to the battery housing 40, the sliding protrusion 613 slides in the sliding groove 45, and the sliding groove 45 is configured to limit the angle of rotation of the base 61 relative to the battery housing 40. When the base 61 rotates to one side relative to the battery housing 40, as shown in FIG. 3, the guiding protrusion 6111 is separated from the guiding groove 44, the mounting groove 43 is exposed, the atomizer 100 is exposed to the outside, and the user can remove the atomizer 100 installed on the bump 612. When the base 61 rotates to the other side relative to the battery housing 40, as shown in FIG. 2, the guiding protrusion 6111 is located in the guiding groove 44, and the mounting groove 43 is covered by the sealing wall 611; at this time, the atomizer 100 is located in the mounting groove 43.

Installation process: when assembling the atomizer 100 and assembling the housing structure 10, the heating structure 20 is placed in the limiting groove 122, and the lower end of the first housing 11 is installed on the second housing 12. When assembling the connecting structure 30 and the housing structure 10, the insulating member 33 is installed in the mounting opening 315 so that the upper end surface of the third abutting portion 331 abuts against the lower end surface of the second abutting portion 313; the first conductive member 31 is installed in the opening 123, the first electrode contact 222 passes through the second receiving groove 314, and the first electrode contact 222 is bent at the lower end of the second limiting portion 121, so that the upper end surface of the first abutting portion 312 abuts against the lower end surface of the second limiting portion 121, and the first bending end 2222 is clamped between the first receiving groove 124 and the upper end surface of the first abutting portion 312; the length of the second electrode contact 223 is firstly trimmed to be appropriate, and the second conductive member 32 is installed in the assembling hole 332, so that the upper end surface of the fourth abutting portion 322 abuts against the lower end surface of the third abutting portion 331. During the installation process, the groove 321 guides the second electrode contact 223 passing through the insertion hole 324 into the mounting hole 323, and the second electrode contact 223 is bent at the position of the limiting step 325 to form the second bending end 2232 which is substantially parallel to the lower end surface of the limiting step 325. The third conductive member 34 is installed in the mounting hole 323, so that the third conductive member 34 abuts against the limiting step 325, and the second bending end 2232 is clamped between the limiting step 325 and the upper end surface of the third conductive member 34.

In use: the battery device 400 is connected to the atomizer 100 to realize the circuit conduction. The electronic cigarette 200 is turned on, as the temperature of the heating member 22 increases, the heating member 22 begins to conduct heat to the heat conducting member 21, and the heat conducting member 21 heats the tobacco product placed in the cavity 211, so that the tobacco product is atomized to form smoke for inhale.

When the circuit is turned on, as the temperature of the first electrode contact 222 and the second electrode contact 223 increases, the temperature of the housing structure 10, the first conductive member 31, the second conductive member 32 and the third conductive member 34 gradually rise. Since the insulating member 33 is made of PEEK material, PEEK material has good insulation property and high temperature resistance, the insulating member 33 can be prevented from decomposing and failing at high temperature.

In the prior art, the first electrode contact 222 is clamped between the first conductive member 31 and the insulating member 33. One side of the first electrode contact 222 is electrically connected to the first conductive member 31. The second electrode contact 223 is clamped between the second conductive member 32 and the insulating member 33. One side of the second electrode contact 223 is electrically connected to the second conductive member 32. The insulating member 33 isolates the electrical connection between the first electrode contact 222 and the second electrode contact 223. The electrical connection between the first electrode contact 222 and the first conductive member 31 is prone to failure, and the electrical connection between the second electrode contact 223 and the second conductive member 32 is also prone to failure. In this embodiment, the first electrode contact 222 is clamped between the housing structure 10 and the first conductive member 31. The first electrode contact 222, wherein the housing structure 10 and the first conductive member 31 are electrically connected to each other; the second electrode contact 223 is clamped between the second conductive member 32 and the third conductive member 34, wherein the second electrode contact 223, the second conductive member 32 and the third conductive member 34 are electrically connected to each other. Therefore, each of the first electrode contact 222 and the second electrode contact 223 is electrically connected on both sides, thereby improving the stability of the electrical connection.

Further, in the prior art, the first electrode contact 222 is clamped between the outer surface of the insulating member 33 and the inner surface of the mounting opening 315 of the first conductive member 31. When the insulating member 33 is installed to the mounting opening 315, the outer surface of the insulating member 33 exerts an upward friction force to the first electrode contact 222 along the axial direction of the insulating member 33, causing the first electrode contact 222 to retract upward, which may cause the electrical connection between the first electrode contact 222 and the first conductive member 31 to be unstable. In this embodiment, the first electrode contact 222 passes through the second receiving groove 314 and is clamped between the first receiving groove 124 and the upper end surface of the first abutting portion 312. Therefore, the stability of the electrical connection between the first electrode contact 222, the housing structure 10 and the first conductive member 31 is not affected by the installation of the first electrode contact 222 to the housing structure 10.

In the prior art, the second electrode contact 223 is clamped between the inner surface of the assembling hole 332 of the insulating member 33 and the outer surface of the second conductive member 32. When the second conductive member 32 is installed to the assembling hole 332, the second conductive member 32 exerts an upward friction force to the second electrode contact 223 along the axial direction of the insulating member 33, causing the second electrode contact 223 to retract upward, which may cause the electrical connection between the second electrode contact 223 and the second conductive member 32 to be unstable. In this embodiment, the second electrode end 2231 passes through the insertion hole 324 and is clamped between the limiting step 325 and the upper end surface of the third conductive member 34. Therefore, the stability of the electrical connection between the second electrode contact 223, the second conductive member 32 and the third conductive member 34 is not affected by the installation of the second conductive member 32 to the insulating member 33.

Furthermore, due to the small size of the second conductive member 32 and the insertion hole 324 therein, when the second electrode contact 223 is installed, the second electrode contact 223 is required to firstly pass through the insertion hole 324 to extend out of the lower end surface of the second conductive member 32. Then, the second conductive member 32 is installed in the assembling hole 332, and then the length of the second electrode contact 223 is trimmed to be appropriate. Since the size of the mounting hole 323 in the second conductive member 32 is relatively small, it is difficult to bend and trim the second electrode contact 223 in the narrow operating space of the mounting hole 323. In this embodiment, the upper end of the second conductive member 32 is provided with a groove 321. On the one hand, when the second conductive member 32 is gradually installed in the assembling hole 332, the groove 321 guides the second electrode contact 223 through the insertion hole 324 to enter into the mounting hole 323. The step of passing the second electrode contact 223 through the insertion hole 324 and the step of installing the second conductive member 32 to the assembling hole 332 are simplified into one step. On the other hand, the user can properly trim the length of the second electrode contact 223 before installing the second conductive member 32, thereby eliminating the adverse effects of bending and trimming in the narrow operating space of the mounting hole 323.

The beneficial effects of the present disclosure are: in the atomizer 100 and/or the electronic cigarette 200 provided by the present disclosure, the insulating member 33 is provided between the first conductive member 31 and the second conductive member 32, the heating structure 20 includes a heat conducting member 21 and a heating member 22 arranged in the heat conducting member 21, the heating member 22 includes a main body 221 and a first electrode contact 222 and a second electrode contact 223 adjacently provided on the main body 221. Both sides of the first electrode contact 222 are respectively electrically connected to the first conductive member 31 and the housing structure 10. Both sides of the second electrode contact 223 are respectively electrically connected to the second conductive member 32 and the third conductive member 34. In the atomizer 100 and/or the electronic cigarette 200 provided by the present disclosure, each of the first electrode contact 222 and the second electrode contact 223 is electrically connected on both sides, thereby increasing the conductive range of the first electrode contact 222 and the second electrode contact 223 to maintain the stability of the electrical connection.

The above embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. An atomizer comprising a housing structure, a connecting structure installed at one end of the housing structure, and a heating structure installed in the housing structure, wherein:

the connecting structure comprises a first conductive member provided below the housing structure, a second conductive member provided in the first conductive member, an insulating member provided between the first conductive member and the second conductive member, and a third conductive member provided in the second conductive member;

the heating structure comprises a heating member, the heating member comprises a main body, and a first electrode contact and a second electrode contact configured for electrically connecting with the main body;

the first electrode contact is clamped between the first conductive member and the housing structure, and the first electrode contact, the first conductive member and the housing structure are electrically connected to each other;

the second electrode contact is clamped between the second conductive member and the third conductive member, and the second electrode contact, the second conductive member and the third conductive member are electrically connected to each other.

2. The atomizer according to claim 1, wherein the first conductive member comprises a first conductive body and a first abutting portion formed by protruding outwardly from the first conductive body along the radial direction of the first conductive body, the first electrode contact is clamped between the upper end surface of the first abutting portion and the housing structure.

3. The atomizer according to claim 2, wherein the outer surface of the first conductive body is provided with a second receiving groove extending downward from the upper end surface of the first conductive body to the upper end surface of the first abutting portion along the axial direction of the first conductive member, the first electrode contact passes through the second receiving groove and is clamped between the upper end surface of the first abutting portion and the housing structure.

4. The atomizer according to claim 3, wherein the lower end surface of the housing structure is provided with an opening for installing the first conductive member, the lower end surface of the housing structure is provided with a first receiving groove in communication with the opening along the radial direction of the housing structure, the first electrode contact passes through the second receiving groove and is clamped between the upper end surface of the first abutting portion and the first receiving groove.

5. The atomizer according to claim 1, wherein the second conductive member comprises a mounting hole provided in the lower end surface of the second conductive member and configured for installing the third conductive member, an insertion hole provided in the upper end surface of the second conductive member and in communication with the mounting hole, the inner diameter of the mounting hole is greater than the inner diameter of the insertion hole, a limiting step is formed at the junction between the mounting hole and the insertion hole, the second electrode contact passes through the insertion hole and is clamped between the limiting step and the third conductive member.

6. The atomizer according to claim 5, wherein the upper end surface of the second conductive member is further provided with a groove in communication with the insertion hole, the groove is formed on the upper end surface of the second conductive member by recessing gradually downwardly along the radial direction of the second conductive member from the outer edge toward the center of the second conductive member, the insertion hole is located at the center of the bottom of the groove.

7. The atomizer according to claim 6, wherein the connecting lines of various points from the outer edge of the groove to the center of the groove along the radial direction of the second conductive member are straight lines, and the angles between the straight lines and the axis of the second conductive member are the same.

8. The atomizer according to claim 1, wherein the lower end surface of the third conductive member is provided with a pressing hole, by applying a force outwardly to the pressing hole along the radial direction of the third conductive member, the side wall of the third conductive member is deformed outwardly along the radial direction of the third conductive member.

9. An electronic cigarette comprising an atomizer according to claim 1.

10. An electronic cigarette comprising an atomizer and a battery device electrically connected to the atomizer, wherein:

the battery device comprises a battery housing and a battery received in the battery housing;

the atomizer comprises a housing structure, a connecting structure installed at the lower end of the housing structure, and a heating structure installed in the housing structure;

the lower end of the housing structure protrudes inwardly along the radial direction of the housing structure to form a second limiting portion, an opening is formed and extends through the second limiting portion from the upper surface to the lower surface of the second limiting portion;

the connecting structure comprises a first conductive member at least partially received in the opening, a second conductive member provided in the first conductive member, an insulating member provided between the first conductive member and the second conductive member, and a third conductive member provided in the second conductive member;

the heating structure comprises a heating member, the heating member comprises a main body, and a first electrode contact and a second electrode contact configured for electrically connecting with the main body;

the first electrode contact is clamped between the first conductive member and the second limiting portion of the housing structure, wherein the first electrode contact, the first conductive member and the housing structure are electrically connected to each other;

the second electrode contact is clamped between the second conductive member and the third conductive member, wherein the second electrode contact, the second conductive member and the third conductive member are electrically connected to each other;

the battery supplies power to the heating member through the first electrode contact and the second electrode contact.

11. The electronic cigarette according to claim 10, wherein the first conductive member comprises a first conductive body and a first abutting portion protruding outwardly from the first conductive body along the radial direction of the first conductive body, the upper end surface of the first abutting portion abuts against the lower end surface of the second limiting portion; the lower surface of the second limiting portion is provided with a first receiving groove, the first electrode contact is clamped between the first receiving groove and the upper end surface of the first abutting portion.

12. The electronic cigarette according to claim 11, wherein the outer surface of the first conductive body is provided with a second receiving groove extending downward from the upper end surface of the first conductive body to the upper end surface of the first abutting portion along the axial direction of the first conductive member, the first electrode contact passes through the second receiving groove and is clamped between the first receiving groove and the upper end surface of the first abutting portion.

13. The electronic cigarette according to claim 11, wherein the first conductive member further comprises a second abutting portion formed at the lower end of the first conductive body and protruding outwardly along the radial direction of the first conductive body, the lower end of the insulating member protrudes outwardly along the radial direction of the insulating member to form a third abutting portion, the first conductive member is provided with a mounting opening extending through the upper end surface and the lower end surface of the first conductive member, the insulating member is at least partially installed in the mounting opening, the upper end surface of the third abutting portion abuts against the lower end surface of the second abutting portion.

14. The electronic cigarette according to claim 13, wherein the insulating member is provided with an assembling hole extending through the upper end surface and the lower end surface of the insulating member, the second conductive member is at least partially installed in the assembling hole, the lower end of the second conductive member protrudes outwardly along the radial direction of the second conductive member to form a fourth abutting portion, the upper end surface of the fourth abutting portion abuts against the lower end surface of the third abutting portion.

15. The electronic cigarette according to claim 10, wherein the lower end surface of the second conductive member is provided with a mounting hole, the upper end surface of the second conductive member is provided with an insertion hole in communication with the mounting hole, the inner diameter of the mounting hole is larger than the inner diameter of the insertion hole, so that a limiting step is formed at the junction between the mounting hole and the insertion hole, the third conductive member is at least partially installed in the mounting hole, the second electrode contact passes through the insertion hole and is clamped between the limiting step and the upper end surface of the third conductive member.

16. The electronic cigarette according to claim 15, wherein the upper end of the second conductive member is further provided with a groove, the groove is formed on the upper end surface of the second conductive member by recessing gradually downwardly along the radial direction of the second conductive member from the outer edge toward the center of the second conductive member, the insertion hole is located at the center of the bottom of the groove.

17. The electronic cigarette according to claim 10, wherein the lower end of the battery housing is provided with a mounting groove, the battery device further comprises a base structure connected to the lower end of the battery housing, the base structure includes a base installed at the lower end of the mounting groove, a first electrode contact member provided in the base, and a second electrode contact member provided in the base, the atomizer is installed on the base.

18. The electronic cigarette according to claim 17, wherein the lower end of the battery housing protrudes outward to form a connecting shaft, the connecting shaft is provided with a leading hole passing through the connecting shaft, the leading hole communicates with the interior of the battery housing, the lead lines of the battery pass through the leading hole in the connecting shaft to enter the base, one of the lead lines is electrically connected to the first electrode contact member, and the other lead line is electrically connected to the second electrode contact member, the first electrode contact member is electrically connected to the first conductive member and/or the housing structure through the base, the second electrode contact member is electrically connected to the second conductive member and/or the third conductive member.

19. The electronic cigarette according to claim 18, wherein the base is rotatable around the connecting shaft relative to the battery housing, the upper surface of the base is provided with a sealing wall; when the base rotates to one side relative to the battery housing, the mounting groove is exposed, and the atomizer is exposed to the outside; when the base rotates to the other side relative to the battery housing, the atomizer is driven by the base to enter into the mounting groove and the mounting groove is covered by the sealing wall.

* * * * *